US006161881A

United States Patent [19]

Babka et al.

[11] Patent Number: 6,161,881

[45] Date of Patent: Dec. 19, 2000

[54] CASEMENT LOCK

[75] Inventors: Brian J. Babka, Hudson; Dave R. Bogenhagen, North Hudson, both of Wis.; Todd W. Bruchu, Lake Elmo, Minn.; James Robert Harger; Thomas Michael Wright, both of Rockford, Ill.; Arthur Raymond King, IV, Machesney Park, Ill.

[73] Assignee: Andersen Corporation, Bayport, Minn.

[21] Appl. No.: 09/343,343

[22] Filed: Jun. 30, 1999

[51] Int. Cl.[7] ..... E05C 9/16

[52] U.S. Cl. ..... 292/26; 292/48

[58] Field of Search ..... 292/11, 24, 26, 292/27, 44–48, 51, 53, DIG. 20, DIG. 47, 159

[56] References Cited

U.S. PATENT DOCUMENTS

| | | | |
|---|---|---|---|
| Re. 35,463 | 2/1997 | Vetter et al. . | |
| 1,070,365 | 8/1913 | Voight . | |
| 1,131,247 | 3/1915 | Kiekert . | |
| 1,817,785 | 8/1931 | Vance . | |
| 1,820,715 | 8/1931 | Vance . | |
| 2,739,002 | 3/1956 | Johnson | 292/24 |
| 3,631,629 | 1/1972 | Bercheux . | |
| 3,733,748 | 5/1973 | Heesch . | |
| 3,782,037 | 1/1974 | Heesch . | |
| 3,811,718 | 5/1974 | Bates . | |
| 3,881,333 | 5/1975 | Christmas . | |
| 3,900,965 | 8/1975 | Mummert . | |
| 3,949,525 | 4/1976 | Bates et al. . | |
| 3,977,711 | 8/1976 | Lajcak . | |
| 4,095,829 | 6/1978 | Van Klompenburg . | |
| 4,227,345 | 10/1980 | Durham, Jr. . | |
| 4,235,046 | 11/1980 | Hess et al. . | |
| 4,258,946 | 3/1981 | Angioletti . | |
| 4,300,794 | 11/1981 | Dunsmoor . | |
| 4,497,135 | 2/1985 | Vetter . | |
| 4,530,531 | 7/1985 | Mantini . | |
| 4,610,472 | 9/1986 | Billingsley . | |
| 4,653,228 | 3/1987 | Yuhas et al. . | |
| 4,703,960 | 11/1987 | Lense . | |
| 4,791,756 | 12/1988 | Simpson . | |
| 4,803,808 | 2/1989 | Greisner . | |
| 4,807,914 | 2/1989 | Fleming et al. . | |
| 4,937,976 | 7/1990 | Tucker et al. . | |
| 4,967,512 | 11/1990 | Schröder et al. . | |
| 4,991,886 | 2/1991 | Nolte et al. . | |
| 5,013,073 | 5/1991 | Pehr . | |
| 5,048,252 | 9/1991 | Osborn . | |
| 5,072,489 | 12/1991 | Aumercier . | |
| 5,087,087 | 2/1992 | Vetter et al. . | |
| 5,087,098 | 2/1992 | Ishizuka . | |
| 5,110,165 | 5/1992 | Piltingsrud . | |
| 5,118,145 | 6/1992 | Tucker . | |
| 5,172,944 | 12/1992 | Munich et al. . | |
| 5,219,193 | 6/1993 | Piltingsrud . | |
| 5,370,428 | 12/1994 | Dreifert et al. . | |
| 5,442,880 | 8/1995 | Gipson . | |
| 5,603,538 | 2/1997 | Evers | 292/215 |
| 5,642,909 | 7/1997 | Swan et al. . | |
| 5,653,485 | 8/1997 | Campbell . | |
| 5,722,704 | 3/1998 | Chaput | 292/26 |
| 5,741,031 | 4/1998 | Bauman et al. . | |

*Primary Examiner*—B. Dayoan
*Assistant Examiner*—Gary Estremsky
*Attorney, Agent, or Firm*—Merchant & Gould P.C.

[57] ABSTRACT

Disclosed is a window and lock assembly for releasably locking a sash component of a window in a closed position with respect to a frame component; wherein the lock assembly includes two catches mounted on said frame component at spaced apart positions. The catches are rotatably movable between locked and unlocked positions, wherein a slide bar connects the two catches. Rotation of the first catch causes rotation of the second catch, wherein in the unlocked position the first catch is rotationally closer to the first keeper than the second catch is to the second keeper.

12 Claims, 4 Drawing Sheets

CASEMENT LOCK

FIELD OF THE INVENTION

The invention relates generally to window lock mechanisms and more specifically to lock mechanisms for casement or swinging windows. More specifically, the invention relates to a lock mechanism for casement windows in which the lock mechanism can compensate for window sashes that are pulled out of square by the action of closing the window.

BACKGROUND OF THE INVENTION

Sash locks for casement and awning windows are well known. Casement and awning windows are typically defined as having one or more glass panels within a sash, with the sash movable within a frame. The sash is mounted in a window frame which is defined by a head jamb on the top, a sill on the bottom and two side jambs. Typically, the sash is secured to the frame via hinges and a window operator which moveably attaches the sash to the frame.

Often, for larger casement and awning windows, a single point lock is insufficient to adequately secure the entire sash to the frame. If the window is too large for a single lock, the comers of the sash may not be pulled tightly into the frame when the window is closed and locked. Consequently, a multiple lock arrangement is typically used for larger windows.

Fleming et al, U.S. Pat. No. 4,807,914, discloses a multipoint window lock for locking a pane-carrying sash in a closed position with respect to a window frame. An operator handle is pivotally movable within the handle unit housing and carries a toothed slideblock in enmeshed engagement with a rack. The pivoting motion of the operator handle within the handle unit housing displaces the rack back and forth within the channel. The rack engages from the handle unit to a remote position in enmeshed engagement with at least one lock device which is also mounted on the frame in a recessed, substantially flush-mounted manner. The rack moves linearly and engages two locks which have gears that enmesh the rack. The linear motion of the rack causes the geared camlocks (catches) to rotate. The rotation of the camlocks engages the camlocks with the keeper, drawing the keeper into a secure position within the camlock. The Fleming et al. locking cams move in unison and engage the keepers at the same time.

Tucker, U.S. Pat. No. 5,118,145 discloses a universal lock for securing any of a variety of different design window sashes closed against any of a variety of different design window frames. The lock includes a pair of spaced keepers 62 and 70 on the window sash, and a tie bar 74 mounted to the window frame and having a pair of rollers 42 and 72 thereon. The tie bar is reciprocal along its axis to selectively move the rollers into or out of engagement with the keepers of the closed window sash to selectively lock or release the sash from the frame. A base pivotally mounts a handle member to the window frame. A coupler link is pivotally secured at one end to the handle member and has a flange at the other end pivotally secured to the tie bar. Rotation of the handle causes linear motion of the tie bar. FIGS. 5 and 6 in Tucker disclose that as the tie bar is moved linearly, the lower locking mechanism contacts the lower keeper before the upper locking mechanism engages the upper keeper.

Campbell, U.S. Pat. No. 5,653,485, discloses an improved single-actuation casement on a window-securing mechanism comprising two cams and a linking arm held in tension upon closing. The cams operate in unison in a clamshell fashion.

Billingsley, U.S. Pat. No. 4,610,472, identifies the problem of the top portion of the window bowing outward as the sash is being pulled to the closed position at column 1, lines 23–29. Billingsley discloses an improved casement window securement mechanism which includes two cams, one handle, a cam linkage and a cam linkage supporting spacer. The top cam is a reaching cam, including a cam ramp with a straight drawing portion, and cam-center and over-center positions. The reaching cam draws a catch at a rate varying with the cam angle of rotation. The securement mechanism draws and positively secures a bowed or warped casement sash.

In rotational multipoint locking systems for casement or other swinging windows, the problem therefore exists that the keeper nearest the window operator nears its corresponding respective lock device on the frame before the other keeper approaches its respective lock device. The action of the lock devices grabbing the keepers at the same time is not a smooth action because the keeper farthest from the window operator is displaced from its respective lock device when such lock device makes contact with the respective keeper.

SUMMARY OF THE INVENTION

Accordingly, an embodiment of the invention is found in a window and lock assembly for releasably locking a sash component of a window in a closed position with respect to a frame component. The assembly comprises two keepers on said sash component and two catches mounted on said frame component at spaced apart positions and each rotatably movable between locked and unlocked positions. The catches lockingly engage with said first and second keepers when said catches are in said locked positions and said sash component is substantially in the closed position. The assembly further comprises a slide bar connecting the first catch to the second catch whereby rotational motion of one catch results in rotational motion of the other catch. The first and second catches have rotational positions relative respectively to the first and second keepers, wherein at the beginning of rotation of the first and second catches from unlocked position to locked position, the rotational position of the first catch is closer to the its respective keeper than the rotational position of the second catch is to its respective keeper.

In another embodiment, the invention is also found in a window and lock assembly for releasably locking a sash component of a window in a closed position with respect to a frame component. The assembly comprises two keepers on said sash component and two catches mounted on said frame component at spaced apart positions and each rotatably movable between locked and unlocked positions. The catches lockingly engage respectively with said first and second keepers when said catches are in said locked positions and said sash component is substantially in the closed position. The first catch further comprises an actuator for moving said catches between said locked and unlocked positions; wherein a slide bar connects the first catch to the second catch whereby rotational motion of the first catch results in rotational motion of the second catch. The first and second catches have rotational positions relative to the first and second keepers, wherein at the beginning of rotation of the first and second catches from unlocked position to locked position, the rotational position of the first catch is 10 to 30° ahead of the rotational position of the second catch in the unlocked position and wherein the second catch rotates at a faster rate than the first catch; wherein the first and second catches rotate in the same direction.

DETAILED DESCRIPTION OF THE PREFERRED EMBODIMENTS

A preferred embodiment of the invention describes a multi-point casement window lock. The lock includes a remote (or top) lock device that includes a remote catch and a bottom lock device that includes a bottom catch and a handle. The two catches are connected by a slide bar and operate in unison. The handle includes a circular base portion which includes teeth. The teeth on the circular portion of the handle interact with teeth on the slide bar. Therefore, rotation of the handle results in linear motion of the slide bar. At the remote catch end, a wheel having teeth is connected to the catch. The wheel with teeth interacts with additional teeth on the slide bar. The wheel transfers the linear motion of the slide bar into rotational motion of the catch. The catches operate between an unlocked position and a locked position. In one preferred embodiment, the remote catch is approximately twenty degrees behind the bottom catch. As the remote catch travels into the locked position, the rotational positional difference between the two catches decreases to zero. Both catches engage the closed position at the same time. Thus, the remote catch rotates faster than the bottom catch. The rotation difference is due to the fact that the gears connected to the remote catch are a different size than the gears connected to the bottom catch.

In the unlocked position, the remote catch operates preferably from about 10 to 30° behind the bottom catch, more preferably about 20° behind.

Figure 1:
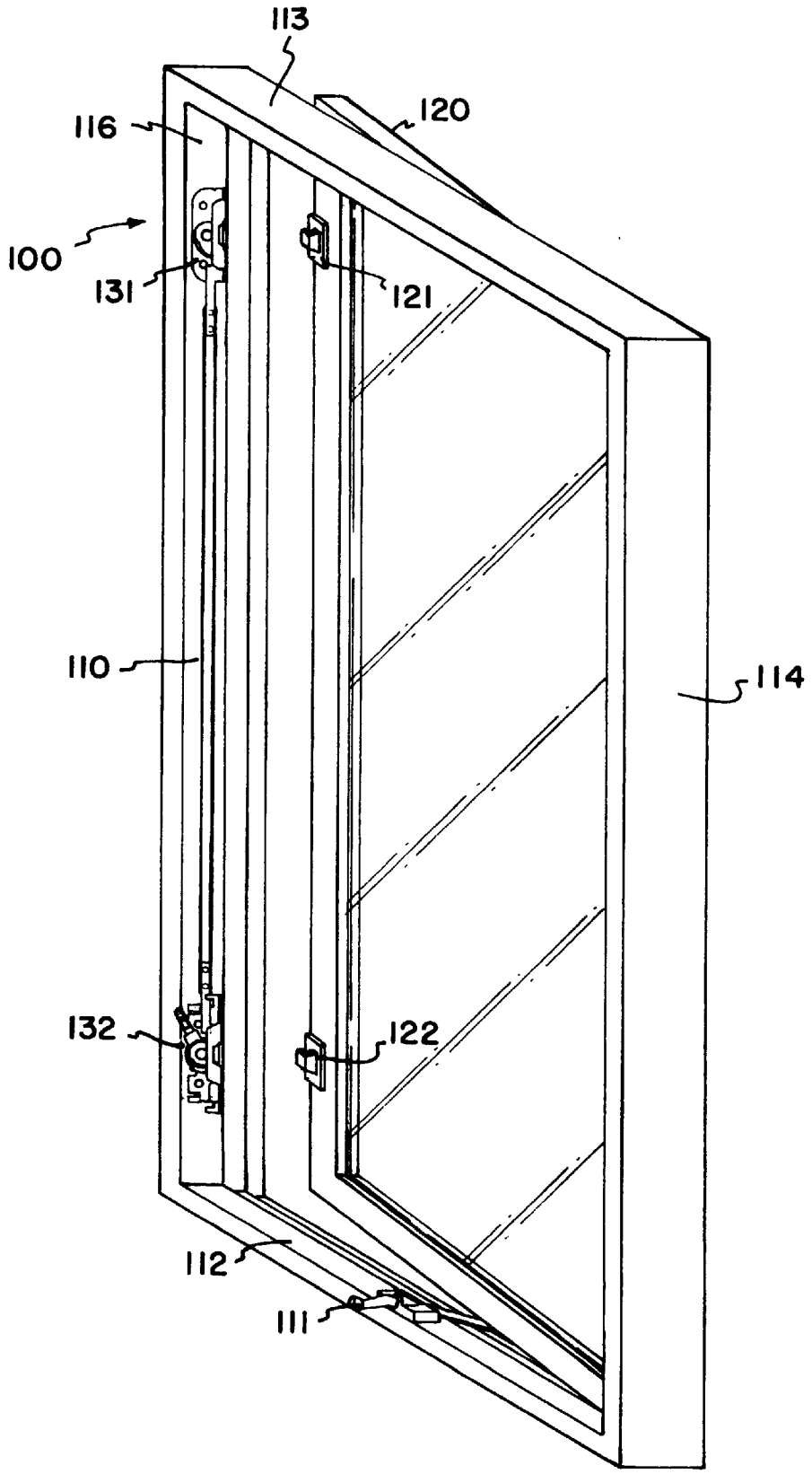
FIG. 1 is a perspective view of a typical window bearing the lock mechanism of the invention with the trim plate removed.

The invention is best understood in relation to the Figures, which illustrate an embodiment of the invention. FIG. 1 is a perspective view of a typical casement window 100 as contemplated by the invention with the trim plate removed. The window 100 includes a sash 120 and a frame 110. The window frame 110 typically includes four components; namely, a top jamb 113, a sill 112, and left and right jambs 114 and 116, respectively. The sash 120 is pivotally attached to the left jamb 114 via one or more hinges (unseen). The sash 120 is further operatively connected to the frame 110 via window operator 111. Typically, window operator 111 will include a handle which can be used to open and close the window.

The right side of the sash 120 is seen in this Figure to include a top keeper 121 and a bottom keeper 122. While casement windows most commonly have two such keepers, it is envisioned that larger windows could use three or even more keepers. The top keeper releasably engages with the top lock device 131, while the bottom keeper 122 releasably engages with the bottom lock device 132. The top and bottom lock devices 131 and 132, respectively, are located on the jamb at the appropriate positions. These positions are chosen for optimal control of the sash. Typically, the lock devices 131 and 132 would be positioned about one-fourth to about one-third of the length of the jamb from each corresponding jamb end. The operation of the lock devices 131 and 132 are best described in relation to the remaining Figures.

Figure 2:
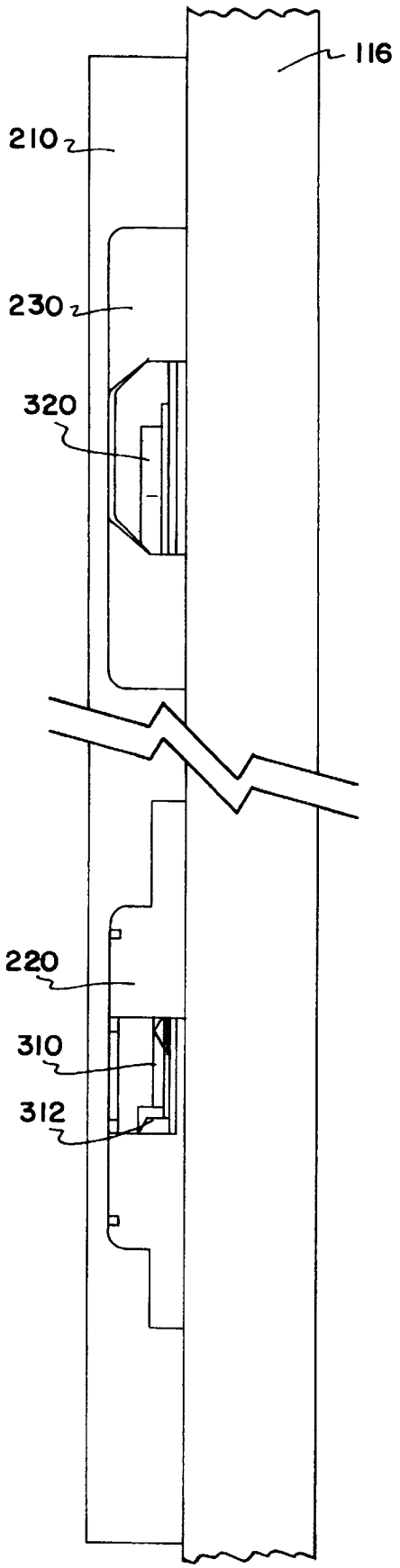
FIG. 2 is a side elevation view of the invention, shown installed in a suitable window frame.

FIG. 2 is a side elevation of right side jamb 116, in which the lock mechanism of the invention is shown in a fully unlocked position. Seen is jamb 116 in parallel with a trim plate 210. In this unlocked position the leading bottom catch edge 312 can be seen through the opening in keeper receiver 220. The leading edge of the top catch 320 cannot be seen behind the keeper receiver 230.

The trim plate 210, along with the other window sash and jamb components can be made from any suitable material known to those of skill in the art. These materials include wood, encased wood and various thermoplastic and thermosetting composite materials.

Figure 3:
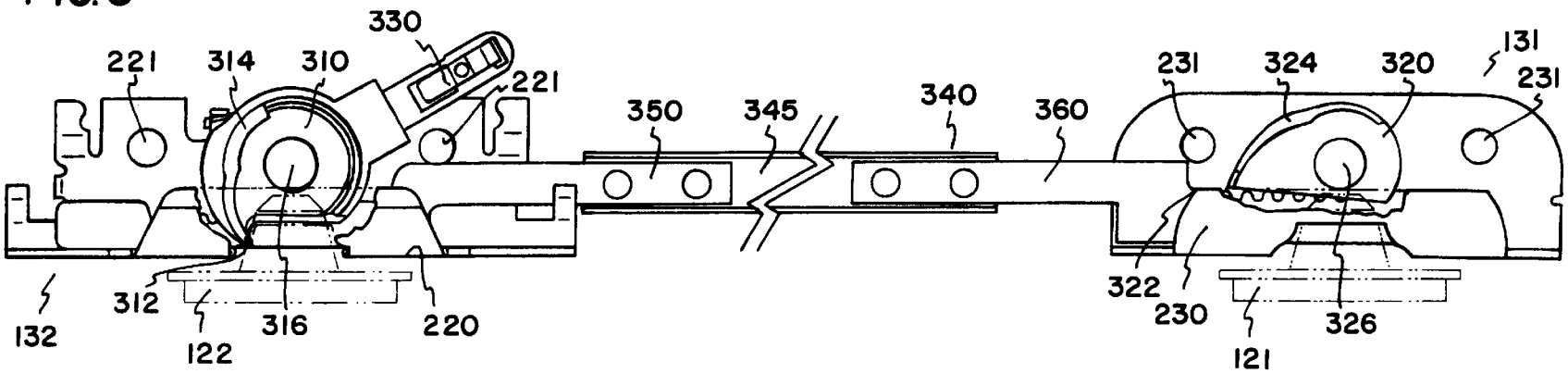
FIG. 3 is schematic view of the invention, showing the lock devices in a completely unlocked position.
Figure 4:
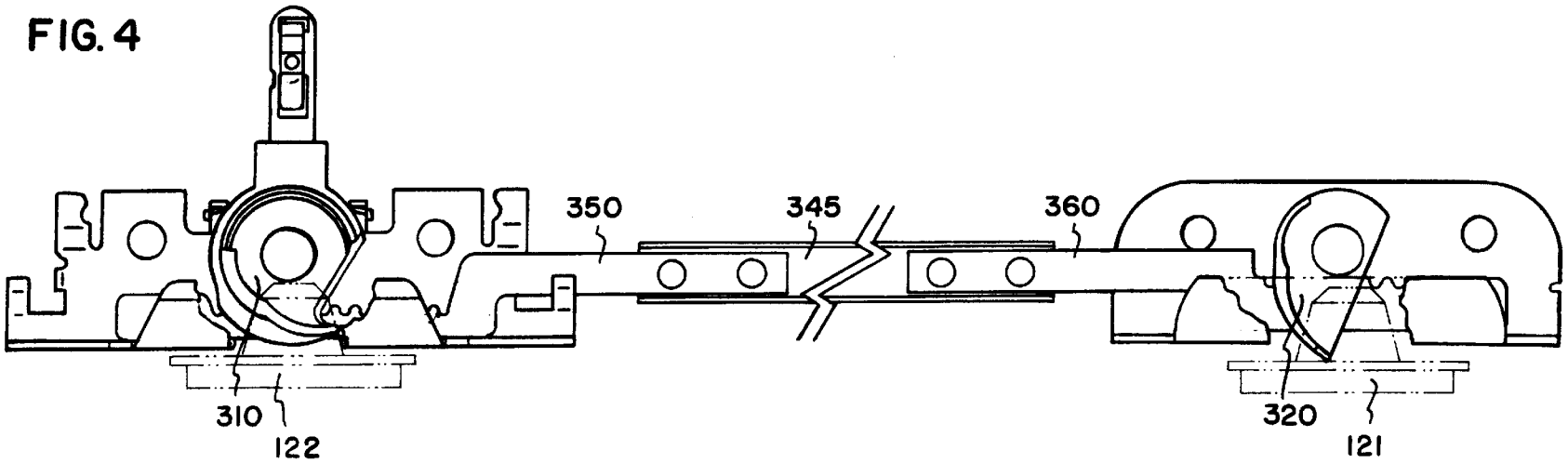
FIG. 4 is a schematic view of the invention, showing the lock devices in a partially locked position.
Figure 5:
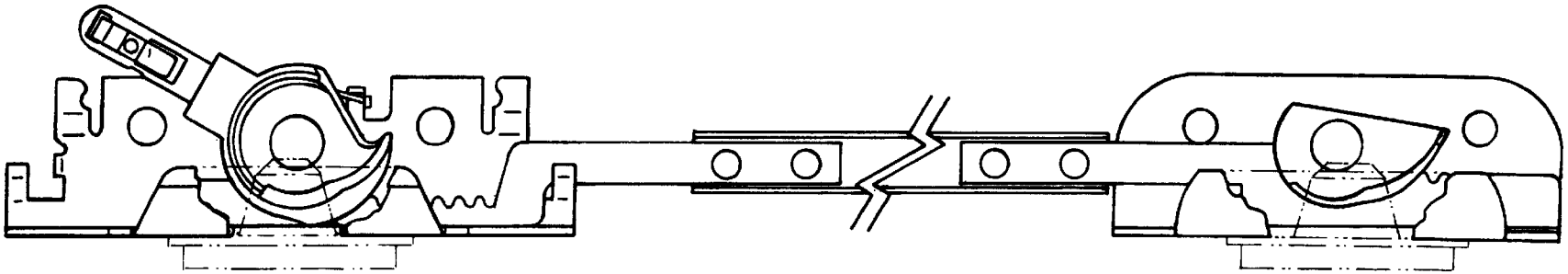
FIG. 5 is a schematic view of the invention, showing the lock devices in a completely locked position.

FIGS. 3, 4 and 5 show the lock mechanism of the invention in varying positions of operation. FIG. 3 is a schematic illustration showing a fully unlocked mechanism, while FIGS. 4 and 5 show partially locked and fully locked positions, respectively. FIG. 3 can be used to discuss operation of the lock mechanism.

The lock mechanism includes a pair of gear rails 350 and 360, which serve to moveably engage catches 310 and 320, respectively. The gear rails 350 and 360 are operatively connected via a bar 345. The bar 345 is sized appropriately for the particular window in question. In the fully open or unlocked position, the bottom lock device 132 is seen as including a catch 310 which has a raised rim 314 suitable to guide and control the bottom keeper 122, which is seen here in phantom. In this embodiment, the catch 310 further includes a handle receiving strut 330. A number of different handles (not shown) can be used, and are chosen largely for cosmetic or decorative reasons. Alternatively, the catch does not have to include a handle. Other means for rotating the catch, such as an electric motor may be used within the scope of this invention.

The top lock device 131 is similarly constructed. It has a raised rail 324, but does not include means for attaching a handle. Instead, it is operated remotely via bottom lock device 132. When the lock mechanism is in its fully open or unlocked position, the top and bottom catches 320 and 310 are in different rotational positions. Preferably, bottom catch 310 is positioned such that it is close to making contact with keeper 122. Simultaneously, top catch 320 is rotatably positioned well away from making contact with keeper 121. This is done because typical casement windows can rack during operation, due to the fact that the window sash is being pulled in from only one point. Since the window operator 111 (in FIG. 1) is typically located at the bottom of the window assembly, the bottom of the sash 120 is typically closer to the frame 110 than is the top of the sash 120.

Keeper receiver 230, which is part of the top lock device 131, includes mounting apertures 231. Likewise, keeper receiver 220 includes mounting apertures 221. Apertures in said trim plate 210 allow room for the top keeper receiver 220 and bottom keeper receiver 230. The keeper receivers 220 and 230, respectively, help to prevent sash movement in high wind situations, and to prevent sash sag.

FIG. 4 shows the same lock mechanism in a partially locked position. In this view, bottom catch 310 has nearly fully engaged keeper 122 while top catch 320 is just beginning to engage keeper 121. It should be noted that although top catch 320 begins in a rotational position well behind that of bottom catch 310, the final rotational positions of the top and bottom catches 320 and 310 are substantially identical. This is accomplished by top catch 320 rotating faster than bottom catch 310. In the illustrated embodiment, top catch 320 has a longer reach than bottom catch 310. This can be seen by comparing the catch length between engaging tip and pivot point. For the bottom catch 310, this distance is measured from pivot point 316 to leading catch edge 312. Similarly, top catch 320 is measured from pivot point 326 to leading edge 322. This longer reach on the top catch 320 further assists in a smooth connection with the keeper.

FIG. 4 also demonstrates the geometric relationship between bottom lock device 132 and top lock device 131. In the partially locked position, gear rail 350 has moved toward lock device 131. This in turn forces gear rail 360 in the same direction, thereby rotating top catch 320. The rotational position of top catch 320 is still behind the rotational position of bottom catch 310.

FIG. 5 shows the same lock mechanism in a fully locked or closed position. This indicates that both top catch 320 and bottom catch 310 have similar stop positions. Note that both keeper 122 and keeper 121 have been drawn tightly against their respective keeper receivers 230 and 220.

Figure 6:
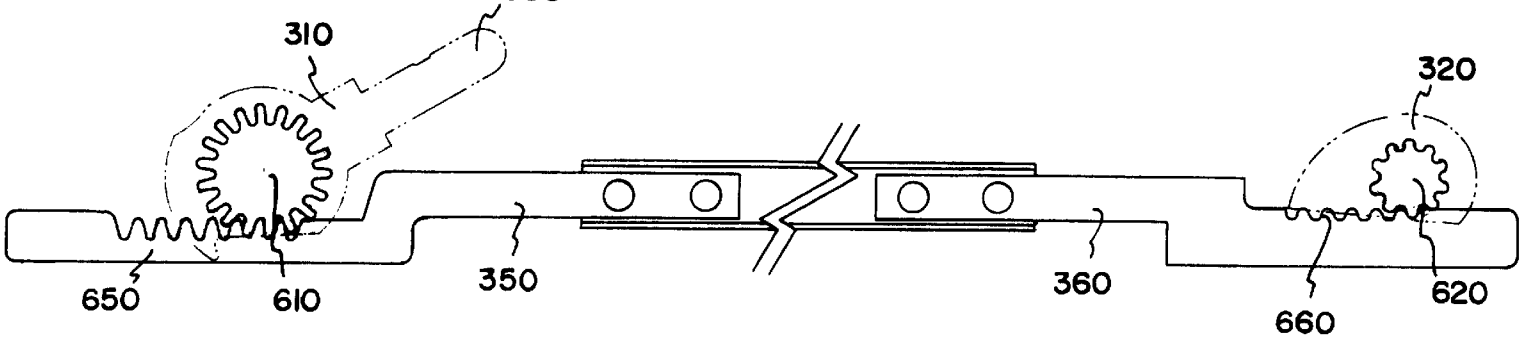
FIG. 6 is a cutaway view of FIG. 3, illustrating the geometric relationship between the two lock devices and the interconnecting slide bar.

FIG. 6 is a reverse cutaway view of FIG. 3, in which the gearing present on each gear rail 350 and 360 is illustrated. Gear rail 350 has a series of gear teeth 650, which engage the corresponding teeth 612 present on catch gear 610, attached to bottom catch 310. Likewise, gear rail 360 has a series of gear teeth 660, which engage the corresponding teeth 622 on catch gear 620 on top catch 320. Note that there are more teeth 612 on catch gear 610 than there are teeth 622 on catch gear 620. This difference in the number of teeth results in the top catch 320 rotating at a faster rate than the bottom catch 310.

It should be noted that while the above description placed the handle on the bottom lock device, this is not necessary. The handle could be placed on the top lock device or the handle could be remote from all lock devices. It is also possible that no handle be used. Note also that if the window operator is attached to the top of the sash and frame, then the rotational offset and difference in rotational rate of the two catches would need to be reversed from the above description. These various embodiments are all contemplated by this invention.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

We claim:

1. A window and lock assembly for releasably locking a sash component of a window in a closed position with respect to a frame component, comprising:

a first keeper on said sash component;

a second keeper on said sash component;

a first catch mounted on said frame component and rotatably movable between locked and unlocked positions, said first catch for locking engagement with said first keeper when said first catch is in said locked position and said sash component is substantially in the closed position;

a second catch mounted on said frame component at a spaced apart position from the first catch and rotatably movable between locked and unlocked positions, said second catch for locking engagement with said second keeper when said second catch is in said locked position and said sash component is substantially in the closed position;

a slide bar connecting the first catch to the second catch whereby rotational motion of one of the first catch and second catch results in rotational motion of the other of the first catch and the second catch;

said first and second catches each having a rotational position around the axis of rotation of the first and second catches respectively, wherein at the beginning of rotation of the first and second catches from unlocked position to locked position, the rotational position of the first catch relative to the axis of rotation of the first catch is different from the rotational position of the second catch relative to the axis of rotation of the second catch.

2. The window and lock assembly of claim 1 wherein the second catch rotates at a faster rate than the first catch.

3. The window and lock assembly of claim 2 wherein the first and second catches reach the final locked position at the same time.

4. The window and lock assembly of claim 2 wherein the rotational position of the first catch is from about 10 to 30° ahead of the rotational position of the second catch when fully unlocked.

5. The window and lock assembly of claim 2 wherein the rotational position of the first catch is from about 15° to 25° ahead of the rotational position of the second catch when fully unlocked.

6. The window and lock assembly of claim 2 wherein the rotational position of the first catch is about 20° ahead of the rotational position of the second catch when fully unlocked.

7. The window and lock assembly of claim 2 further comprising an actuator connected to the first catch.

8. A window and lock assembly for releasably locking a sash component of a window in a closed position with respect to a frame component, comprising:

a first keeper on said sash component;

a second keeper on said sash component;

a first catch mounted on said frame component and rotatably movable between locked and unlocked position, said first catch for locking engagement respectively with said first keeper when said first catch is in said locked position and said sash component is substantially in the closed position;

a second catch mounted on said frame component at a spaced apart position and rotatably movable between locked and unlocked position, said second catch for locking engagement with said first keeper when said second catch is in said locked position and said sash component is substantially in the closed position;

said first catch comprising an actuator for moving said first catch between said locked and unlocked positions;

a slide bar connecting the first catch to the second catch whereby rotational motion of the first catch results in rotational motion of the second catch;

said first and second catches having rotational positions relative respectively to the first and second keepers, wherein at the beginning of rotation of the first and second catches from unlocked position to locked position, the rotational position of the first catch is 10° to 30° ahead of the rotational position of the second catch in the unlocked position; wherein the second catch rotates at a faster rate than the first catch; and wherein the first and second catches rotate in the same direction.

9. The window and lock assembly of claim 8 wherein the first catch is about 15° to 25° ahead of the second catch when fully unlocked.

10. The window and lock assembly of claim 8 wherein the first catch is about 20° ahead of the second catch when fully unlocked.

11. The window and lock assembly of claim 8 wherein the first and second catches reach the locked position at the same time.

12. A window and lock assembly for releasably locking a sash component of a window in a closed position with respect to a frame component, comprising:

a first keeper on said sash component;

a second keeper on said sash component;

a first catch mounted on said frame component and rotatably movable between locked and unlocked positions, said first catch for locking engagement with said first keeper when said first catch is in said locked position and said sash component is substantially in the closed position;

a second catch mounted on said frame component at a spaced apart position from the first catch and rotatably movable between locked and unlocked positions, said second catch for locking engagement with said second keeper when said second catch is in said locked position and said sash component is substantially in the closed position;

a slide bar connecting the first catch to the second catch whereby rotational motion of one of the first catch and second catch results in rotational motion of the other of the first catch and the second catch;

said first and second catches having rotational positions relative respectively to the first and second keepers, wherein at the beginning of rotation of the first and second catches from unlocked position to locked position, the rotational position of the first catch is closer to the first keeper than the rotational position of the second catch is to the second keeper and wherein the second catch rotates at a faster rate than the first catch.

* * * * *